US006272697B1

(12) United States Patent
Park

(10) Patent No.: US 6,272,697 B1
(45) Date of Patent: Aug. 14, 2001

(54) LIE-DOWN PERSONAL SAUNA

(76) Inventor: Min H. Park, 7175 Orangethorpe Ave., Buena Park, CA (US) 90621

( * ) Notice: Subject to any disclaimer, the term of this patent is extended or adjusted under 35 U.S.C. 154(b) by 0 days.

(21) Appl. No.: 09/594,924

(22) Filed: Jun. 15, 2000

(30) Foreign Application Priority Data

Jul. 2, 1999 (KR) ..... 99-12889

(51) Int. Cl.[7] ..... A61H 33/06
(52) U.S. Cl. ..... 4/524; 607/83
(58) Field of Search ..... 4/524–533, 615; 607/81, 82, 83

(56) References Cited

U.S. PATENT DOCUMENTS

| | | | | |
|---|---|---|---|---|
| 463,490 | * | 11/1891 | Crank | 4/532 |
| 1,157,842 | * | 10/1915 | Brandelle | 4/525 |
| 2,184,418 | * | 12/1939 | Faigle | 607/81 |
| 4,565,188 | * | 1/1986 | Hardie | 4/524 X |
| 4,884,574 | * | 12/1989 | Hardie et al. | 4/529 X |

FOREIGN PATENT DOCUMENTS

| | | | | |
|---|---|---|---|---|
| 5049670 | * | 3/1993 | (JP) | 4/524 |

* cited by examiner

*Primary Examiner*—Robert M. Fetsuga
(74) *Attorney, Agent, or Firm*—John K. Park; Park & Sutton LLP

(57) ABSTRACT

A lie-down personal sauna comprises a base plate having a substantially middle portion, a first cover having a front edge and a bottom edge, a second cover having a lower edge, a rear edge and a cutout, a hingedly attaching member, and a heating member. The bottom edge is attached to the base plate so that the first cover partially covers the base plate. The hingedly attaching member attaches the second cover to either the first cover or the substantially middle portion of the base plate so that the second cover can be moved from an open position to a closed position through the hingedly attaching member. The base plate, the first cover and the second cover form a substantially enclosed cavity when the second cover is at the closed position, and the user is received into the cavity at the open position of the second cover and maintained within the personal sauna under the closed position of the second cover.

16 Claims, 4 Drawing Sheets

LIE-DOWN PERSONAL SAUNA

CLAIMING FOREIGN PRIORITY

The applicant claims and requests a foreign priority, through the Paris Convention for the Protection of Industry Property, based on a patent application filed in the Republic of Korea (South Korea) with the filing date of Jul. 2, 1999, with the application number 99-12889, by the applicant. (See the Attached Declaration)

BACKGROUND OF THE INVENTION

The present invention relates to a sauna device. More particularly, the present invention relates to a lie-down personal sauna device which improves usability and convenience by providing a hinge-opening mechanism.

Generally, it is known that sauna satisfies skin cosmetic purposes and improves body health. In recent years, a demand on portable sauna facility has been increasing on the market. A wide range of its prospects or customers include beauty salons, tanning salons, day spas, skin care centers, health care providers, etc. Such a personal sauna facility is also used at home and for medical purposes.

FIG. 6 shows a lie-down personal sauna device according to a prior art. As shown therein, a conventional lie-down personal sauna device 1 employs a slide-opening mechanism. Specifically, the conventional sauna device 1 includes a base plate 3, a first cover 5, a second cover 7, a control box 8 and an electrical cord 9. The first cover 5 fixedly covers a half of the base plate 3. The second cover 7 slides over the first cover 5 to open the device 1 and it is pulled forward to cover the other half of the base plate 3 to begin the sauna operation. To complete the sauna operation, the heated second cover 7 should be slid back and overlapped with the first cover 5 so that the first cover 5 becomes exposed to heat.

Such a conventional structure has several disadvantages. First, since the second cover has to be overlapped with the first cover when the second cover is slidably released open, the outer surface of the first cover is subject to deformation resulting from sauna heat from the second cover. Second, the second cover has to be pulled over by a user for sauna use in a state in which the user has lied down on the base, thereby causing inconvenience in controlling the sauna device. Third, the slidable structure consumes a significant amount of electrical power to open/close the second cover.

SUMMARY OF THE INVENTION

This present invention is contrived to overcome the conventional disadvantages and others demerits. Accordingly, it is an object of the present invention to provide a lie-down personal sauna device which employs a hinge-opening mechanism, thereby improving usability and convenience.

Another object of the present invention is to maximize sauna effect while minimizing power consumption by enabling its opening/closing operation using a slight amount of manual force.

To achieve the above-described objects and others, a lie-down personal sauna device according to the present invention comprises a base plate, a first cover, a second cover, a hingedly attaching means, and a heating means. The base plate has a substantially middle portion. The first cover has a front edge and a bottom edge. The bottom edge is attached to the base plate so that the first cover partially covers the base plate. The second cover has a lower edge, a rear edge and a cutout so that a portion of a user's body can be extended out through the cutout.

The hingedly attaching means attaches the second cover to either the first cover or the substantially middle portion of the base plate so that the second cover can be moved from an open position to a closed position through the hingedly attaching means. When the second cover is at the closed position, the base plate, the first cover and the second cover form a substantially enclosed cavity. In this construction, the user is received into the cavity at the open position of the second cover and maintained within the personal sauna under the closed position of the second cover. Also, the heating means serves to heat the cavity. The heating means comprises a heat emitting sheet embedded within each of the base plate, the first cover and the second cover. The base plate may also comprise a plurality of foldable legs extending from a lower surface thereof.

In an improvement, a packing member may be fixedly carried on at least one of the front edge of the first cover and the rear edge of the second cover so as to prevent air communication between the front edge of the first cover and the rear edge of the second cover when the second cover is at the closed position. The packing member may be heat resistant. A flexible cushion member may be disposed on the base plate to improve the user's comfortablity.

For a better performance, the first cover has a first left side hinge area and a first right side hinge area. The second cover has a second left side hinge area and a second right side hinge area. The hingedly attaching means has a left side hinge and a right side hinge so that the left side hinge is sequentially hinged through the first and second left side hinge areas and the right side hinge is sequentially hinged through the first and second right side hinge areas.

The personal sauna may further comprise at least one damper connecting the second cover and the base plate to smoothly open, close and adjust the second cover, wherein the damper is disposed adjacent to a selected one of the left side hinge and the right side hinge.

According to an embodiment, a control panel is attached on an outer surface of the second cover and adjacent to the cutout to control the personal sauna. The control panel comprises an operation indicator, an error indicator, and a plurality of first control buttons, wherein the operation indicator visually indicates normal operations of the personal sauna and temperatures in the cavity, wherein the error indicator visually indicates erroneous operations of the personal sauna, and wherein the first control buttons separately control the respective operations of the personal sauna.

The control panel may further comprise a plurality of second control buttons disposed on an inner surface of the second cover and adjacent to the cutout so that the user can control the sauna operations while lying within the cavity. Also, the heat emitting sheet is connected to an external power source and controllably to the control panel.

In another embodiment, the personal sauna further comprises a means for generating far infrared radiation. The infrared generating means is carbon-coated and disposed on the heating means. The carbon-coated infrared generating means is activated by a conductive line connected at each side thereof. Also, a cover layer having a plurality of through holes is disposed on the infrared generating means so that the cover layer, the infrared generating means and the heating means are sequentially laminated and exposedly embedded within at least one of the base plate, the first cover and the second cover. The carbon-coated far infrared generating means may be further coated by an insulation compound resin to prevent an electrical short.

The advantages of the present invention are numerous. First, the lie-down personal sauna device enables a user to conveniently open/close the second cover by providing a hinge-opening mechanism. Second, the personal sauna device substantially decreases power consumption to as low a level as that of a hair dryer by utilizing energy efficiency mechanism. Third, the dual control system allows a user to control its operation from inside the sauna device, thereby maximizing convenience and usability.

Although the present invention is briefly summarized, the fuller understanding of the invention can be obtained by the following drawings, detailed description and appended claims.

BRIEF DESCRIPTION OF DRAWINGS

These and other features, aspects and advantages of the present invention will become better understood with reference to the accompanying drawings, wherein.

DETAILED DESCRIPTION OF THE PREFERRED EMBODIMENTS

Figure 1:
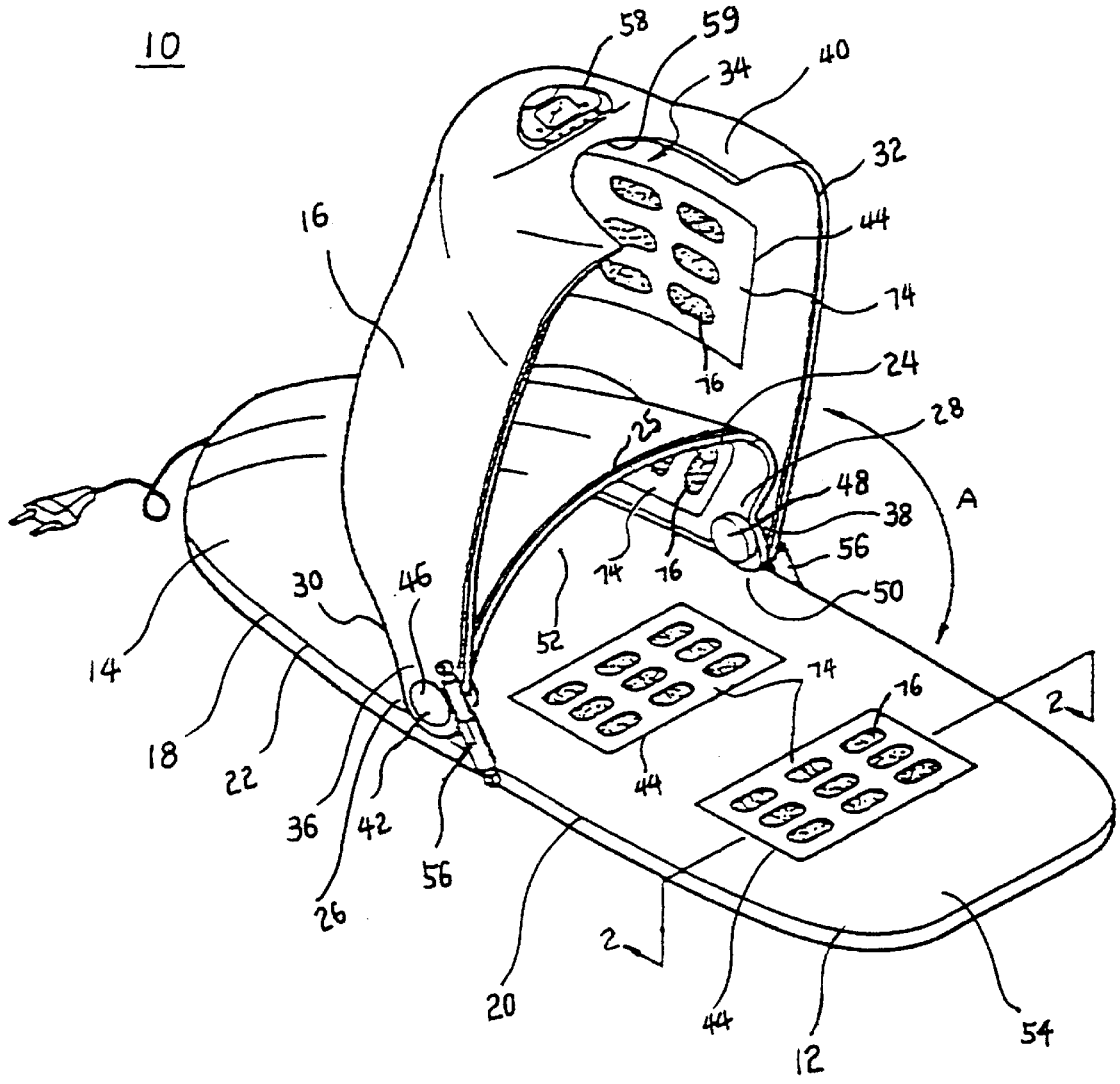
FIG. 1 is a perspective view illustrating an opened state of a lie-down personal sauna device according to a preferred embodiment of the present invention.

As shown in FIG. 1, a lie-down personal sauna 10 according to the present invention comprises a base plate 12, a first cover 14 and a second cover 16. The first cover 14 may be preferably formed unitary with the base plate 12. The base plate 12 has a first perimeter 18 and a second perimeter 20. The first cover 14 has a bottom edge 22, a front edge 24, a first left side hinge area 26 and a first right side hinge area 28. The second cover 16 has a rear edge 30, a lower edge 32, a cutout 34, a second left side hinge area 36, and a second right side hinge area 38.

The first left and right side edges 26, 28 respectively initiate the bottom edge 22 and the front edge 24. The front edge 24 is shaped in dome when viewed from the front thereof. The bottom edge 22 is attached on and along the first perimeter 18 for fixture between the base plate 12 and the first cover 14 so that the first cover 14 partially covers the base plate 12. Also, the second left and right side edges 36, 38 respectively initiate the rear edge 30 and the lower edge 32. The rear edge 30 is shaped in dome when viewed from the rear thereof. Preferably, an angle formed by the bottom edge 22 and the front edge 24 of the first cover 14 is substantially larger than another angle formed by the rear edge 30 and the lower edge 32 of the second cover 16. It is also preferred that the first and second covers 14, 16 are respectively formed of a heat resistant compound resin such as an FRP (fiber reinforced plastic). The cutout 34 is upwardly arc-shaped and sized extending from a front portion 40 of the lower edge 32 of the second cover 16.

Figure 2:
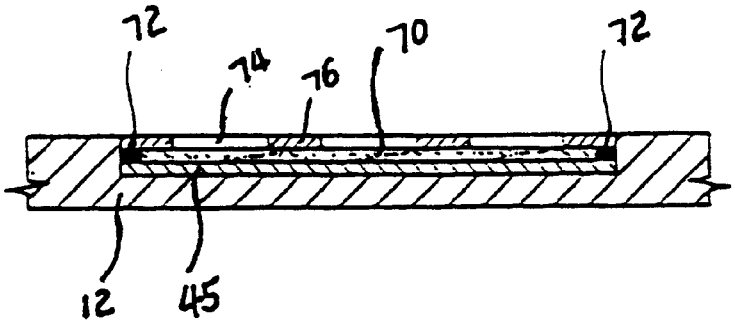
FIG. 2 is a cross-sectional view taken along line 2—2 in FIG. 1.

For a better performance, the lie-down personal sauna 10 further comprises a hingedly attaching means 42 and a heating means 44 having a heat emitting sheet 45 as shown in FIG. 2. The attaching means 42 comprises a left side hinge 46 and a right side hinge 48. The left side hinge 46 hingedly connects the second cover 16 to the first cover 14 so that the second cover 16 can be opened and closed thereby. Specifically, the left side hinge 46 is sequentially hinged through the first and second left side hinge areas 26, 36 and the right side hinge 48 is sequentially hinged through the first and second right side hinge areas 28, 38.

In this construction, when a user lies down on the base plate 12 and pulls down the second cover 16 that hingedly operates with the first cover 14, the lower edge 32 of the second cover 16 fits on and along the second perimeter 20 of the base plate 12 while the user's head remains extending throughout the cutout 34.

When the second cover 16 is hingedly or rotatably closed by the side hinges 46, 48 of the attaching means 42, the rear edge 30 of the second cover 16 becomes tightly overlapped with the front edge 24 of the first cover 14, and at the same time the lower edge 32 of the second cover 16 becomes fittingly placed on and along the second perimeter 20 of the base plate 12.

In an embodiment, the base plate 12 has a substantially middle portion 50 between the first perimeter 18 and the second perimeter 20 thereof so that the hingedly attaching means 42 attaches the second cover 16 to either the first cover 14 or the substantially middle portion 50 of the base plate 12. With the hinge mechanism of the attaching means 42, the second cover 16 can be moved from its open position to its closed position through the hingedly attaching means 42 within an angle A between the lower edge 32 of the second cover 16 and the second perimeter 20 of the base plate 12 . The angle A is preferred to range zero to 120 degrees.

Accordingly, when the second cover 16 is at the closed position, a substantially enclosed cavity 52 is formed by the base plate 12, the first cover 14 and the second cover 16, whereby the user is received into the cavity 52 at the open position of the second cover 16 and maintained within the personal sauna 10 under the closed position of the second cover 16.

The personal sauna 10 further comprises a packing member 25 fixedly carried on at least one of the front edge 24 of the first cover 14 and the rear edge 30 of the second cover 16 so as to prevent air communication between the front edge 24 of the first cover 14 and the rear edge 30 of the second cover 16 when the second cover 16 is at the closed position. The packing member 25 is preferred to be heat resistant.

For a better performance, a flexible cushion member 54 may be disposed on the base plate 12 to improve the user's comfortablity. The cushion member 54 may be formed of a flexible material such as polyurethane. Also, at least one damper 56 may be disposed adjacent to a selected one of the left side hinge 46 and the right side hinge 48 to smoothly open, close and adjust the second cover 16. The damper 56 substantially decreases a required force for closing/opening the second cover 16 and enables the second cover 16 to stop where the user desires.

Figure 3:
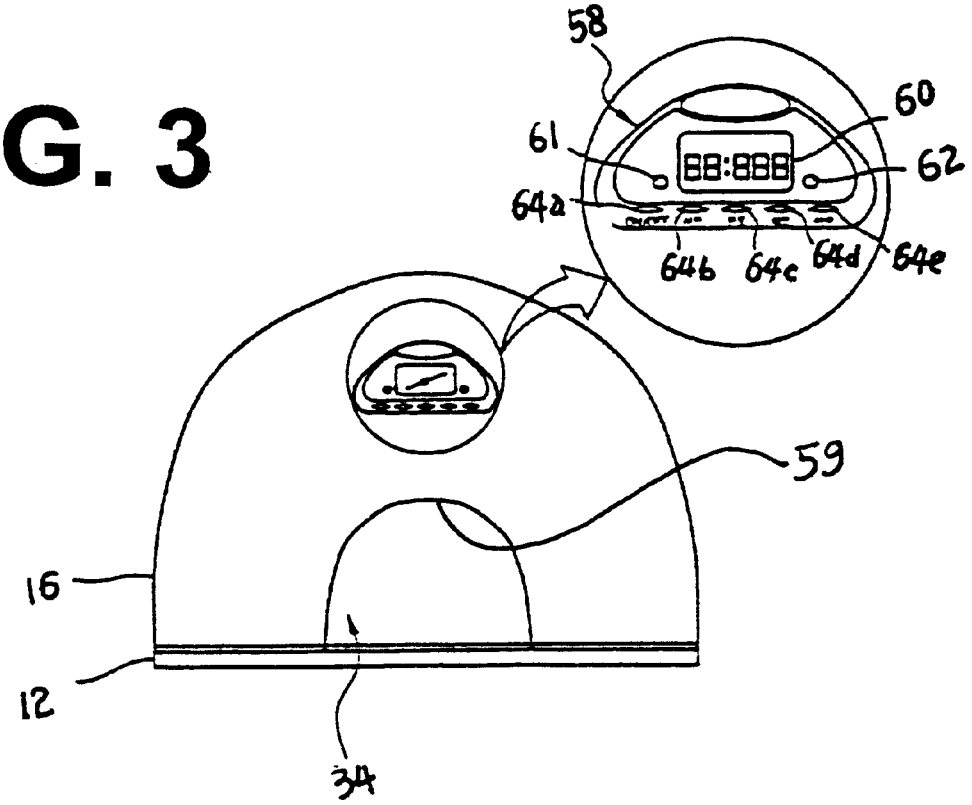
FIG. 3 is a front view of the lie-down personal sauna device together with an enlargement view of a control panel according to the present inventiion.

Referring to FIG. 3, in order to conveniently control the operation of the personal sauna 10, a control panel 58 is attached on an outer surface 59 of the second cover 16 and adjacent to the cutout 34. The control panel 58 comprises a display 60, a first indicator 61, a second indicator 62, and a plurality of first control buttons 64. The display 60 visually indicates respective operations of the personal sauna 10, such as an operational time period and a temperature in the cavity 52. The first indicator 61 shows a normal operation and the second indicator 62 serves to alert an erroneous operation. Also, the first control buttons 64 separately control the respective operations of the personal sauna 10. For example, the button 64*a* controls power supply to the personal sauna 10, the button 64*b* controls the time period of sauna operation, the button 64*c* controls the temperature within the cavity 52, and the buttons 64*d*, 64*e* respectively serve to control the start and finish of the sauna operation.

Figure 4:
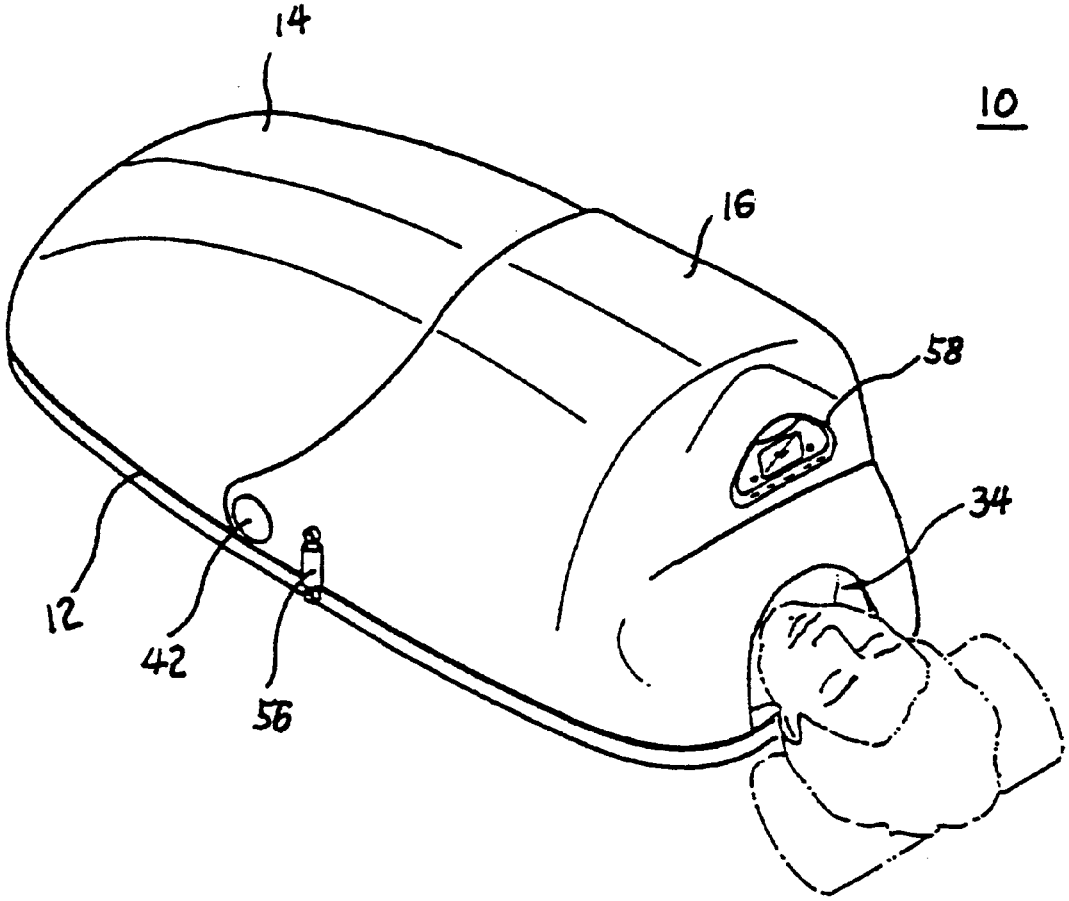
FIG. 4 is a perspective view illustrating a closed state of the lie-down personal sauna device for sauna operation according to the present invention.

In a preferred version, the control panel 58 may further comprise a plurality of second control buttons disposed on an inner surface (not shown) of the second cover 16 and adjacent to the cutout 34 so that the user as shown in FIG. 4 can control the sauna operations while lying within the cavity 52.

Figure 5:
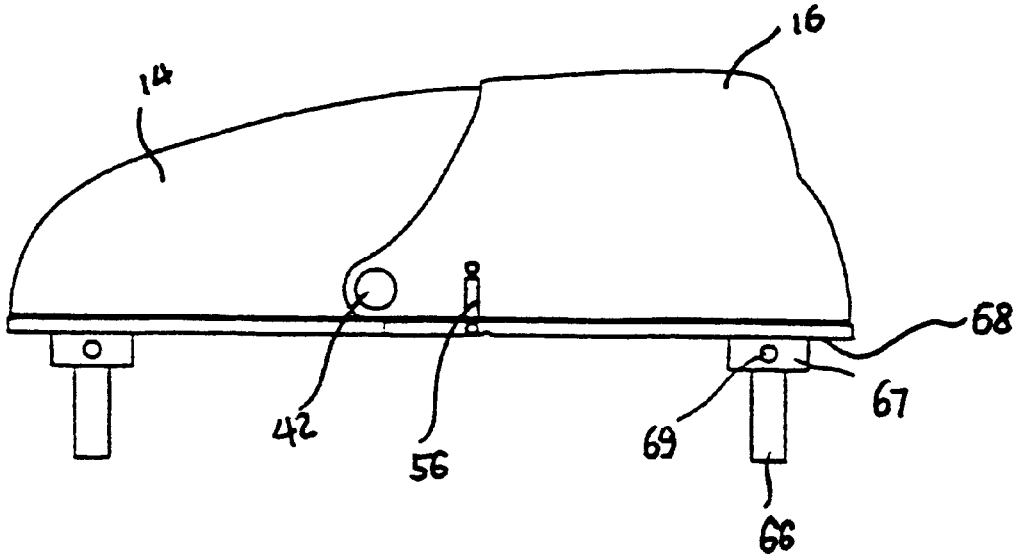
FIG. 5 is a side view illustrating another embodiment of the present invention.
Figure 6:
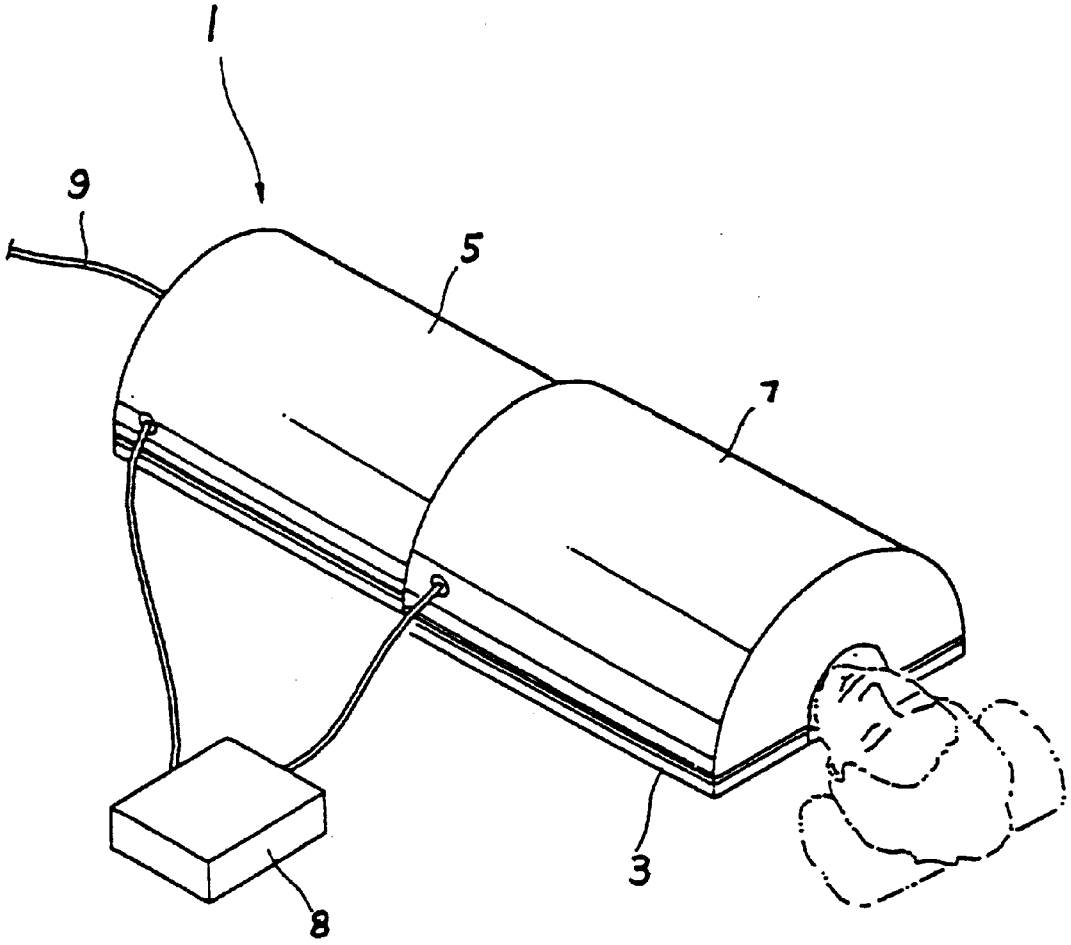
FIG. 6 PRIOR ART
FIG. 6 is a perspective view of a lie-down personal sauna device according to a prior art.

As further shown in FIG. 5, the base plate 12 further comprises a plurality of foldable legs 66 extending from a lower surface 68 thereof so that the personal sauna can be vertically adjustable for thereby improving usability. Also, a bracket 67 having a hinge pin 69 passing therethrough may be disposed between the lower surface 68 and each of the foldable legs 66 so that the foldable legs 66 can be hingedly folded, thereby improving usability.

Referring back to FIG. 2, the heat emitting sheet 45 incorporates the heating means 44 and serves to heat the cavity 52. The heat emitting sheet 45 is embedded within one or more of the base plate 12, the first cover 14 and the second cover 16. The heat emitting sheet 45 is connected to an external power source (not shown) and controllably to the control panel 58. The personal sauna 10 further comprises a means 70 for generating far infrared radiation. The infrared generating means 70 is carbon-coated and disposed on the heating emitting sheet 45. The carbon-coated infrared generating means 70 is activated by a conductive line 72 connected at each side thereof. The infrared generating means 70 is cowered by a cover layer 74 having a plurality of through holes 76.

So the cover layer 74, the infrared generating means 70 and the heating means 44 are sequentially laminated within at least one of the base plate 12, the first cover 14 and the second cover 16. Selectively, the sequential lamination can be either externally exposed or disposed underneath the cushion member 54. The carbon-coated far infrared generating means 70 may be further coated by an insulation compound resin to prevent an electrical short.

The operation of the personal sauna 10 according to the present invention will now be described. When the control panel 58 is appropriately set using required buttons thereon, the user places himself/herself into the cavity 52 and lies down on the base plate 12. The second cover 16 is lowered by the user until it fits on the second periphery 20 of the base plate 12. At this time, the user's head sticks out through the cutout 34 as shown in FIG. 4.

When the personal sauna 10 is powered on and the electric current applies to the conductive lines 72, the carbon-coated far infrared emitting means 70 having semiconductive characteristic is raised in temperature since it serves as resistance against the applied current. The emitting means 70 discharges far infrared radiation when its temperature reaches up to about 80° C. At this time, the discharged wave length ranges about 7 □ m to 12 □ m. The thusly discharged far infrared radiation are released through the through holes 76 into the cavity 52. The temperature in the cavity 52 is maintained above about 60° C.

The advantages of the present invention are numerous. First, the lie-down personal sauna device enables a user to conveniently open/close the second cover using a slight manual force by adopting a hinge-opening mechanism. Second, the personal sauna device substantially decreases power consumption to as low a level as that of a hair dryer by utilizing energy efficiency mechanism. Third, the dual control system allows a user to control its operation from inside the sauna device, thereby maximizing convenience and usability.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A lie-down personal sauna comprising:

a) a base plate having a substantially middle portion;

b) a first cover having a front edge and a bottom edge, wherein the bottom edge is attached to the base plate so that the first cover partially covers the base plate;

c) a second cover having a lower edge, a rear edge and a cutout, wherein a portion of a user's body can be extended out through the cutout;

d) a means for hingedly attaching the second cover to either the first cover or the substantially middle portion of the base plate, wherein the second cover can be moved from an open position to a closed position through the hingedly attaching means, wherein the second cover rotates substantially over the first cover by the hingedly attaching means, wherein the base plate, the first cover and the second cover form a substantially enclosed cavity when the second cover is at the closed position, and wherein the user is received into the cavity at the open position of the second cover and maintained within the personal sauna under the closed position of the second cover; and e) a means for heating the cavity.

2. The lie-down personal sauna of claim 1, wherein the second cover further comprises of a rear edge whereby the rear edge is directly over the first cover at an open position.

3. The personal sauna of claim 2 further comprising a packing member fixedly carried on at least one of the front edge of the first cover and the rear edge of the second cover so as to prevent air communication between the front edge of the first cover and the rear edge of the second cover when the second cover is at the closed position, and wherein the packing member is heat resistant.

4. The personal sauna of claim 3, wherein a flexible cushion member is disposed on the base plate to improve the user's comfort.

5. The personal sauna of claim 4, wherein the first cover has a first left side hinge area and a first right side hinge area, wherein the second cover has a second left side hinge area and a second right side hinge area, wherein the hingedly attaching means has a left side hinge and a right side hinge, and wherein the left side hinge is sequentially hinged through the first and second left side hinge areas and the right side hinge is sequentially hinged through the first and second right side hinge areas.

6. The personal sauna of claim 5, further comprising at least one damper connecting the second cover and the base plate to smoothly open, close and adjust the second cover, wherein the damper is disposed adjacent to a selected one of the left side hinge and the right side hinge.

7. The personal sauna of claim 6, further comprising a control panel attached on an outer surface of the second cover and adjacent to the cutout to control the personal sauna.

8. The personal sauna of claim 7, wherein the control panel comprises a display, a first indicator, a second indicator, and a plurality of first control buttons, wherein the display visually indicates respective operations of the personal sauna such as a temperature in the cavity, wherein the first indicator shows a normal operation and the second indicator alerts an erroneous operation, and wherein the first control buttons separately control the respective operations of the personal sauna.

9. The personal sauna of claim 8, wherein the base plate comprises a plurality of foldable legs extending from a lower surface thereof.

10. The personal sauna of claim 9, wherein the heating means comprises a heat emitting sheet embedded within each of the base plate, the first cover and the second cover, and wherein the heat emitting sheet is connected to an external power source and controllably connected to the control panel.

11. The personal sauna of claim 1, further comprising a means for generating far infrared radiation, wherein the infrared generating means is carbon-coated and disposed on the heating means, wherein the carbon-coated infrared generating means is activated by a conductive line connected at each side thereof, wherein a cover layer having a plurality of through holes is disposed on the infrared generating means, wherein the cover layer, the infrared generating means and the heating means are sequentially laminated and exposedly embedded within at least one of the base plate, the first cover and the second cover.

12. The personal sauna device of claim 11, wherein the carbon-coated far infrared generating means is further coated by an insulation compound resin to prevent an electrical short.

13. A lie-down personal sauna comprising:

a) a base plate having a substantially middle portion;

b) a first cover having a front edge and a bottom edge, wherein the bottom edge is attached to the base plate so that the first cover partially covers the base plate;

c) a second cover having a lower edge, a rear edge and a cutout, wherein a portion of a user's body can be extended out through the cutout;

d) a means for hingedly attaching the second cover to either the first cover or the substantially middle portion of the base plate, wherein the second cover can be moved from an open position to a closed position through the hingedly attaching means, wherein the base plate, the first cover and the second cover form a substantially enclosed cavity when the second cover is at the closed position, and wherein the user is received into the cavity at the open position of the second cover and maintained within the personal sauna under the closed position of the second cover, wherein the first cover has a first left side hinge area and a first right side hinge area, wherein the second cover has a second left side hinge area and a second right side hinge area, wherein the hingedly attaching means has a left side hinge and a right side hinge, and wherein the left side hinge is sequentially hinged through the first and second left side hinge areas and the right side hinge is sequentially hinged through the first and second right side hinge areas;

e) means for heating the cavity;

f) a packing member fixedly carried on at least one of the front edge of the first cover and the rear edge of the second cover so as to prevent air communication between the front edge of the first cover and the rear edge of the second cover when the second cover is at the closed position, and wherein the packing member is heat resistant;

g) a flexible cushion member is disposed on the base plate to improve the user's comfort;

h) at least one damper connecting the second cover and the base plate to smoothly open, close and adjust the second cover, wherein the damper is disposed adjacent to a selected one of the left side hinge and the right side hinge; and i) a control panel attached on an outer surface of the second cover and adjacent to the cutout to control the personal sauna.

14. The personal sauna of claim 13, wherein the control panel comprises a display, a first indicator, a second indicator, and a plurality of first control buttons, wherein the display visually indicates respective operations of the personal sauna such as a temperature in the cavity, wherein the first indicator shows a normal operation and the second indicator alerts an erroneous operation, and wherein the first control buttons separately control the respective operations of the personal sauna.

15. The personal sauna of claim 14, wherein the base plate comprises a plurality of foldable legs extending from a lower surface thereof.

16. The personal sauna of claim 14, wherein the heating means comprises a heat emitting sheet embedded within each of the base plate, the first cover and the second cover, and wherein the heat emitting sheet is connected to an external power source and controllably connected to the control panel.

* * * * *